United States Patent [19]

Davis

[11] 4,190,895

[45] Feb. 26, 1980

[54] METHOD AND APPARATUS FOR ROTATING CARTESIAN COORDINATE SIGNALS

[75] Inventor: Thomas J. Davis, Richland, Wash.

[73] Assignee: Electric Power Research Institute, Inc., Palo Alto, Calif.

[21] Appl. No.: 890,478

[22] Filed: Mar. 27, 1978

[51] Int. Cl.[2] ..... G06G 7/22

[52] U.S. Cl. ..... 364/815; 364/603

[58] Field of Search ..... 364/815, 817, 603, 731; 324/137, 138, 158, 222

[56] References Cited

U.S. PATENT DOCUMENTS

| | | | |
|---|---|---|---|
| 3,078,042 | 2/1963 | Grado | 364/817 |
| 3,187,169 | 6/1965 | Trammel, Jr. et al. | 364/815 |
| 3,371,199 | 2/1968 | Schwartzenberg et al. | 364/815 |
| 3,457,394 | 7/1969 | Grado | 364/815 |
| 3,473,011 | 10/1969 | Schmid | 364/815 |
| 3,482,086 | 12/1969 | Caswell | 364/521 |
| 3,684,880 | 8/1972 | Togawa et al. | 364/815 |
| 3,723,718 | 3/1973 | Jaffee et al. | 364/815 X |
| 4,047,014 | 9/1977 | Morrison | 364/816 |

*Primary Examiner*—Joseph F. Ruggiero
*Attorney, Agent, or Firm*—Flehr, Hohbach, Test, Albritton & Herbert

[57] ABSTRACT

A method and apparatus for rotating cartesian coordinate signals x, y about an angle $\theta°$. The apparatus converts the x, y signals into polar coordinate signals $\sigma$, $\phi$ and then changes the angle $\phi$ by $\theta°$.Theapparatus then converts the resulting signals back into cartesian coordinate signals x', y'.

11 Claims, 3 Drawing Figures

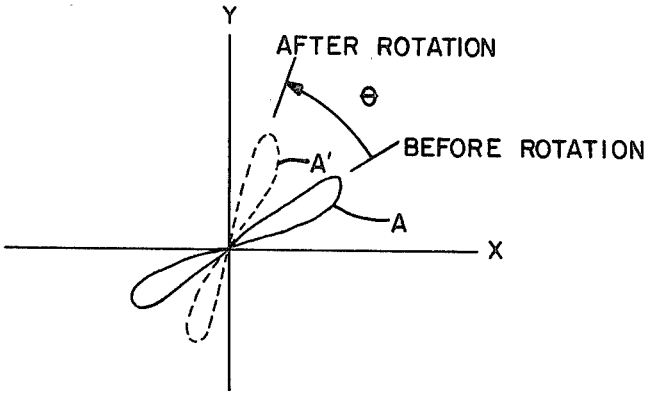
FIG.—1
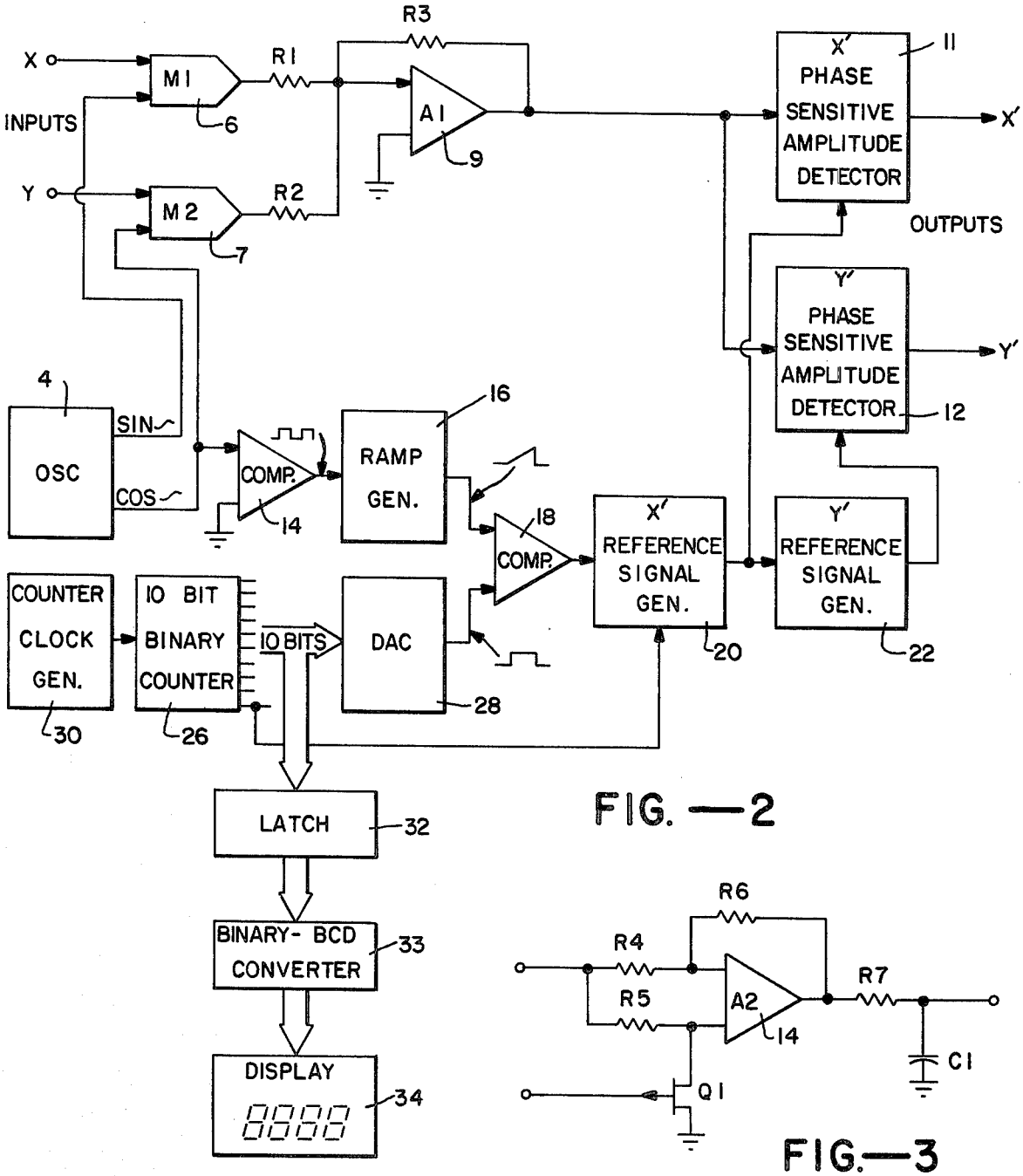
FIG.—2
FIG.—3

METHOD AND APPARATUS FOR ROTATING CARTESIAN COORDINATE SIGNALS

BACKGROUND OF THE INVENTION

This invention generally relates to electrical circuits and, more particularly, to electrical circuits for rotating cartesian coordinate signals.

A phase rotator is a device having two input ports for receiving cartesian coordinate signals x, y and two output ports for cartesian coordinate signals x', y'. The transfer characteristics of a phase rotator are:

$$x' = x \cos \theta - y \sin \theta \quad \text{Eq. 1}$$

$$y' = y \cos \theta + x \sin \theta \quad \text{Eq. 2}$$

where $\theta$ is a pre-determined angle of rotation.

Phase rotators are commonly used in processing the signals measured by eddy current inspection instruments when non-destructively testing for flaws, discontinuities, and cracks in metallic materials. Curve A in FIG. 1 illustrates the signal response pattern from a typical single frequency, eddy current inspection probe. The probe has two output data signals and when this data is displayed on an x-y oscilloscope, a Lissajou pattern results.

Typically, phase rotators are used to rotate the signal response pattern as it is displayed in cartesian coordinates and to remove unwanted test parameters from the data signals. One such parameter is the probe-to-specimen spacing between the eddy current probe and the object being measured. This spacing induces an error that appears as a straight line on an x, y cartesian presentation. A phase rotator is used to rotate the signals until the error is fully contained on either the x or the y axis. The output signal displayed along the other axis is then free of the error and is used as the measured parameter.

A plurality of phase rotators are commonly used in connection with a multiple frequency eddy current inspection probe to process the measured multiple frequency data. A plurality of phase rotators can process multifrequency data by treating this data as an N-dimensional vector space problem. The multiple rotators perform a process similar to the simultaneous solution of multiple independent equations.

Although most eddy current inspection instruments today have phase rotators, these rotators incorporate sine and cosine potentiometers and operational amplifiers to perform the transfer function, Equations 1 and 2. These potentiometers typically require manual adjustment and inject noise into the output signals. Further, these circuits lack high resolution and limit the amount of data which can be obtained by this type of signal processing.

OBJECTS AND SUMMARY OF THE INVENTION

It is an object of the present invention to eliminate the use of sine and cosine potentiometers and to provide a simple phase rotation circuit that is totally electronic.

It is another object of the present invention to develop an electronic phase rotator circuit which is controlled by an external digital device such as a computer and is susceptible to automatic control.

It is a further object of the present invention to develop a phase rotator circuit that provides high resolution of the rotation angle $\theta$ so that a high order of accuracy can be achieved.

The foregoing and other objects are achieved by a circuit for rotating cartesian coordinate signals x and y about an angle $\theta$. The circuit includes means for converting cartesian coordinate input signals into polar coordinate signals $\sigma$, $\phi$ and means for varying these polar coordinate signals by a predetermined angle $\theta$. The resulting polar coordinate signals are thereafter converted back to cartesian coordinate signals x', y' where:

$$x' = x \cos \theta - y \sin \theta \quad \text{Eq. 1}$$

$$y' = y \cos \theta + x \sin \theta \quad \text{Eq. 2}$$

Additional objects and features of the invention will appear from the following description in which the prefered embodiment has been set forth in detail in conjunction with the accompanying drawings.

BRIEF DESCRIPTION OF THE DRAWINGS

FIG. 1 is a diagram of a cartesian coordinate system illustrating the rotation of curve A by an amount $\theta$ and the resulting new curve A'.

FIG. 2 is a block diagram of a phase rotator circuit according to the present invention.

FIG. 3 is a schematic diagram of one of the phase sensitive amplitude detectors in the circuit of FIG. 2.

DESCRIPTION OF THE PREFERRED EMBODIMENT

FIG. 2 illustrates a circuit for rotating cartesian coordinate signals x, y about an angle $\theta$ where $x = f(t)$ and $y = f'(t)$. This rotation is shown in FIG. 1 where curve A is formed by the original x, y signals being displayed on an x-y cartesian oscilloscope and curve A' is formed by the rotated signals x', y'.

If the circuit of FIG. 2 is connected to an eddy current inspection instrument, the signals x and y represent the Fourier amplitude coefficients of the eddy currents that are circulated in the test specimen (not shown). These signals are analog and can vary in frequency over a range of 0 to 200 hertz. The band width of the signals is a function of the rate at which the probe is pulled through the test specimen. When the two data signals are displayed on an x-y cartesian coordinate oscilloscope, the resulting pattern can be correlated to material properties or flaws in the test specimen.

Referring to FIG. 2 the circuit includes an oscillator 4 which provides a carrier signal of frequency f. The frequency of the oscillator is not critical but should be a value that is at least ten times larger than the value of the highest frequency in the input signals x, y. In the prefered embodiment the oscillator has a frequency of 25 kilohertz. One output of the oscillator is a sine wave which is fed to an analog multiplier M1, 6. The other output is a cosine wave which is fed to a second analog multiplier M2, 7. The first analog multiplier 6 multiplies the x input signal by the sine wave from the oscillator so that the x signal amplitude modulates the sine wave. The output of the first multiplier is thus proportional to $x \sin 2\pi ft$. The second analog multiplier 7 multiplies the y input signal by the cosine signal so that the y signal amplitude modulates the cosine wave. Its output is proportional to $y \cos 2\pi ft$. Each analog multiplier is used in a double side band suppressed carrier mode. The analog multipliers are of known construction and the output of each is the product of the inputs divided by a factor of ten.

The output of the first analog multiplier 6, FIG. 2 is passed through a resistor R1 and combined with the output of the second analog multiplier 7 which is passed through a resistor R2. These two outputs are summed together in a summing amplifier A1, 9. The input resistances R1 and R2 to the amplifier are equal. In effect, the in-phase and quadrature modulated carriers are summed together in the summing amplifier 9. The output of the summing amplifier is a twenty-five kilohertz sine wave having a zero to peak amplitude that is equal to the square root of $x^2+y^2$ and a phase angle measured with respect to the original sine wave carrier signal that is equal to the arc tangent of y divided by x. The output of the amplifier A1, 9 can also be expressed as:

$$f(t)=x \sin 2\pi ft+y \cos 2\pi ft \qquad \text{Eq. 3}$$

This output comprises the input signals x, y converted into polar coordinates.

The output of the summing amplifier 9 is supplied to two phase sensitive amplitude detectors 11, 12. Each phase sensitive detector converts the polar coordinate signals back into cartesian coordinates. Besides the output from the amplifier 9, each phase sensitive amplitude detector also receives reference signals which are obtained by delaying the reference sine and cosine waves by the desired angle of rotation $\theta$. The reference signal applied to the x' phase sensitive detector 11 is a signal corresponding to the angle of rotation $\theta$. The reference signal applied to the y' phase sensitive amplitude detector 12 is the same reference signal delayed by 90°. Each amplitude detector has an output which is proportional to the product of the amplitudes of its two inputs multiplied by the cosine of the phase angle between the two inputs.

FIG. 3 illustrates a schematic diagram for one of the phase sensitive amplitude detectors. The circuit includes an operational amplifier 14 and a transistor Q1. The input signal to resistors R4, R5 is from the output of the summing amplifier 9. The input to the transistor Q1 is a reference signal which is a square wave that has been delayed with respect to the reference signal from the oscillator 4 by an amount proportional to the angle of rotation $\theta$. The transistor Q1 operates as a voltage controlled resistor and forces the gain of the amplifier circuit to either +1 or −1, depending on the state of the reference input. This results in the signal present at the output of amplifier 14 being the input signal multiplied by +1 or −1. The timing or phase of the reference signal with respect to the 25 kilohertz sinusoid from oscillator 4 establishes the rotation angle $\theta$. The output of the summing amplifier 9 is thus multiplied by +1 for a half period of the reference signal, and by −1 for the other half period. The output of amplifier 14 is applied to a low pass filter formed by resistor R7 and a capacitor C1. This low pass filter extracts the DC component of the signal and performs the mathematical averaging for the integration as described below. The D.C. component is proportional to the product of the two inputs multiplied by the cosine of the angle between them. The outputs x' and y' are thus in cartesian coordinate form and are rotated by an angle $\theta=(T/P)360°$ where T=the time delay and P=the period of the carrier signal.

The time delay between the reference signals that are applied to the phase sensitive amplitude detectors 11, 12, FIG. 2 is established by converting a digitally stored value representing the rotation angle into an analog signal and comparing this analog signal to a ramp waveform. In particular, the cosine output from the oscillator 4 is connected to a comparator 14. A comparator is a zero crossing detector since its reference leg is connected to ground. The output of the comparator is a square wave of the same frequency which is passed to a ramp generator 16. The leading edge of each pulse of the square wave triggers the ramp generator so that the output of the ramp generator is timed to coinside with the zero crossing of the cosine wave from the oscillator 4.

The amplitude of the output signal from the ramp generator 16, FIG. 2 is compared in a second comparator 18 with a signal corresponding to the desired rotation angle $\theta$. When the amplitude of the ramp output signal from generator 16 is equal to the input to the comparator 18 from the DAC 28, the comparator initiates a triggering pulse which is passed to the x' reference signal generator 20. This generator is a monostable multivibrator (one shot) whose time delay is set equal to one half period of the 25 kilohertz carrier frequency. The output of this monostable is then a square wave of 50% duty factor and is applied to the x' phase sensitive amplitude detector as a reference signal. The positive going zero crossing of this output is passed to the y' reference signal generator where it is delayed by 90° and used to trigger a second monostable. The output of the second monostable is also set for a half period of the carrier frequency and is applied to the y' phase sensitive amplitude detector 12.

The second comparator 18, FIG. 2 which compares the analog angle value from the DAC 28 with the ramp output signal from the ramp generator 16 permits digital control and selection of the rotation angle $\theta$. The desired rotation angle in digital form is stored in a 10 bit binary counter 26. A digital word size of ten bits is used so that a full circle of rotation is split up into 1024 parts. Each count corresponds to approximately $\frac{1}{3}$ of a degree of rotation. The output of the 10 bit binary counter is converted by a digital-to-analog convertor (DAC) 28 into an analog signal. The output of the DAC is compared with the ramp signal in the comparator 18 and thus the time of initiating of the reference signal zero crossing is determined.

The counter clock generator 30 is used either to count the 10 bit binary counter up or down or to reset it. In this way the digital value of the desired rotation angle $\theta$ is selected. The selected rotation angle is displayed by taking the output of the 10 bit binary counter 26 and passing it to a latch 32 and a binary to BCD converter 33. The output of the converter is presented on a digital display 34 so that the operator can see the selected angle of rotation.

In operation, the inputs to the circuit of FIG. 2 are the signals x=f(t) and y=f'(t). The output signals from the oscillator 4 are sin $2\pi ft$ and cos $2\pi ft$. The analog multiplier M1, 6 multiplies its two inputs together and has an output of x sin $2\pi ft$. The second analog multiplier M2, 7 also multiplies its two inputs and has an output of y cos $2\pi ft$. The summing amplifier 9 adds these two signals and has a polar coordinate output of $$f(t)=\sigma \sin 2\pi ft-\phi \qquad \text{Eq. 4}$$

where $\sigma=\sqrt{x^2+y^2}$ and $\phi=\arctan y/x$

Each phase sensitive amplitude detector 11, 12 multiplies the amplitudes of its two inputs by the cosine of the phase angle between them. The transfer function for the x' phase sensitive amplitude detector 11 is $$PSD_1 = \frac{K}{P}\left[\int_{\frac{\theta}{w}}^{\frac{P}{2}+\frac{\theta}{w}} f(t)dt + \int_{\frac{P}{2}+\frac{\theta}{w}}^{P+\frac{\theta}{w}} -f(t)dt\right] \quad \text{Eq. 5}$$

where $w=2\pi f$ and $P=1/f$.

The transfer function for the y' phase sensitive amplitude detector 12 is $$PSD_2 = \frac{K}{P}\left[\int_{\frac{\theta+\frac{\pi}{2}}{w}}^{\frac{P}{2}+\frac{\theta+\frac{\pi}{2}}{w}} f(t)dt + \int_{\frac{P}{2}+\frac{\theta+\frac{\pi}{2}}{w}}^{P+\frac{\theta+\frac{\pi}{2}}{w}} -f(t)dt\right] \quad \text{Eq. 6}$$

Since f(t) in Eq. 4 is a sinusoid, the integrals reduce to $$PSD_1 = \frac{2K}{P}\left[\int_{\frac{\theta}{w}}^{P/2+\frac{\theta}{w}} f(t)dt\right] \quad \text{Eq. 6}$$

$$PSD_2 = \frac{2K}{P}\left[\int_{\frac{\theta+\pi/2}{w}}^{P/2+\frac{\theta+\pi/2}{w}} f(t)dt\right] \quad \text{Eq. 7}$$

The output of the x' phase sensitive amplitude detector 11 is thus $$x'=2K/\pi[x\cos\theta-y\sin\theta] \quad \text{Eq. 8}$$

The output of the y' phase sensitive amplitude detector is $$y'=2K/\pi[y\cos\theta+x\sin\theta] \quad \text{Eq. 9}$$

The constant K is chosen to be $\pi/2$ and thus $$x'=x\cos\theta-y\sin\theta \quad \text{Eq. 1}$$

$$y'=y\cos\theta+x\sin\theta \quad \text{Eq. 2}$$

Referring to FIG. 1, the circuit of FIG. 2 takes the input signals x, y as illustrated by curve A and rotates the curve by an angle $\theta$. After rotation the curve A' is generated and is a plot of the signals x', y' as defined by equations 1 and 2.

It should be understood that although the phase sensitive amplitude detector illustrated in FIG. 3 is used in the prefered embodiment, there are a variety of other ways of implementing this circuit component. Analog multipliers, for example, can be used and the reference signals are the reference sine and cosine waves delayed by an appropriate amount corresponding to angle $\theta$. The analog multipliers are followed by low pass filters which extract the D. C. component of the multiplied waveforms. In both embodiments the transfer function Equations 1 & 2 is achieved.

In another embodiment, the reference signals can remain fixed in time with respect to the 25 kilohertz carrier, and the polar coordinate signals from the output of the summing amplifier 9 can be delayed directly by using a phase lag circuit. In both embodiments the output signals x',y' are then rotated by $\theta=(T/P)360°$ where T is the time delay and P is the period of the carrier signal from the oscillator 4.

The present invention also contemplates digital generation of reference signal timing. In this embodiment a digital method replaces the DAC, ramp generator, comparator and associated circuitry. A high frequency clock is used having a frequency of 1024 times higher than the carrier frequency f of the oscillator 4. The output from the clock is digitally divided down by 1024 and used to synchronize the oscillator 4. The clock also drives the 10 bit binary counter 26. The counter output and the stored rotation angle are compared in a binary comparator (not shown). When the two values are equal, the comparator output is used to initiate the x' reference signal. For the y' reference signal, a value of 256 counts for 90° is subtracted from the counter output using a binary adder (not shown). This output is compared to the stored value of the rotation angle in the second binary comparator (not shown) and the resultant output is used to initiate the y' reference signal. Since the binary counters are driven at a frequency one thousand and twenty-four times higher than the carrier frequency f of the oscillator 4, a full circle of rotation is split up into a thousand and twenty-four parts.

It is also contemplated that a plurality of phase rotators can be combined together so that multi-frequency eddy current signals can be processed and the undesirable parameters eliminated. Thus, although the best modes contemplated for carrying out the present invention have been herein shown and described, it will be apparent that modification and variation may be made without departing from what is regarded to be the subject matter of the invention.

What is claimed is:

1. Apparatus for rotating cartesian coordinate signals x, y about an angle $\theta$ where $x=f(t)$, $y=f'(t)$, and $\theta$ is a pre-determined angle, comprising:

(a) means for converting the cartesian coordinate signals x, y into a wave form $F(\sigma,\phi,t)=\sigma\sin(2\pi ft-\phi)$ where $\sigma$ and $\phi$ are polar coordinate values defined by $\sigma=\sqrt{x^2+y^2}$ and $\phi=\arctan y/x$ and where $F(\sigma,\phi,t)$ is a polar coordinate signal;

(b) means connected to the converting means for varying the phase of the polar coordinate signal $F(\sigma,\phi,t)$ by a pre-determined angle $\theta$; and (c) phase sensitive amplitude detecting means connected to the varying means for converting the resulting polar coordinate signal $F(\sigma,\phi,\theta t)=\sigma\sin(2\pi ft-\phi-\theta)$ back into cartesian coordinate signals x', y' where $$x'=x\cos\theta-y\sin\theta$$

$$y'=y\cos\theta+x\sin\theta$$

2. An apparatus as in claim 1 wherein the cartesian to polar coordinate converting means includes:

(a) an oscillator for generating a carrier signal of frequency f, said oscillator having one output proportional to $\sin 2\pi ft$ and a second output proportional to $\cos 2\pi ft$;

(b) analog multiplier means for amplitude modulating said first and second outputs from the oscillator by respectively the signals x and y; and (c) summing means for adding the output from the analog multiplier means, said summing means having a time varying polar coordinate output which is a function of the signals x, y.

3. An apparatus as in claim 1 wherein the polar coordinate signal $F(\sigma,\phi,t)$ varying means includes timing means for delaying with respect to a carrier signal of frequency f the polar coordinate signal $F(\sigma,\phi,t)$ by an amount proportional to the rotation angle $\theta$ where $$\theta=(T/P)360°$$

where T=the time delay and P=the period of the carrier signal and wherein the phase sensitive amplitude detecting means includes two of said detectors for converting the resulting polar coordinate signal $F(\sigma,\phi,\theta,t)$ back into cartesian coordinate signals x', y', said detectors being actuated by reference signals that are separated in phase by 90° of a period of the carrier signal.

4. An apparatus as in claim 1 wherein the polar to cartesian coordinate converting means includes two phase sensitive amplitude detectors, said detectors being actuated by reference signals from a timing means which delays the reference signals with respect to a carrier signal of frequency f by an amount proportional to the rotation angle $\theta$, where $$\theta=(T/P)360°$$

where T=the time delay and P=the period of the carrier signal, said reference signals being separated in phase by 90° of a period of the carrier.

5. An apparatus as in claim 1 wherein the phase sensitive amplitude detecting means includes a first phase sensitive amplitude detecting means having a transfer function $$PSD_1=\frac{K}{P}\left[\int_{\frac{\theta}{w}}^{\frac{P}{2}+\frac{\theta}{w}} f(t)dt+\int_{\frac{P}{2}+\frac{\theta}{w}}^{P+\frac{\theta}{w}} -f(t)dt\right]$$

where $P=2\pi/w$, w=the angular frequency of the carrier signal, and P=the period of the carrier signal and a second phase sensitive amplitude detecting means having a transfer function $$PSD_2=\frac{K}{P}\left[\int_{\frac{\theta+\frac{\pi}{2}}{w}}^{\frac{P}{2}+\frac{\theta+\frac{\pi}{2}}{w}} f(t)dt+\int_{\frac{P}{2}+\frac{\theta+\frac{\pi}{2}}{w}}^{P+\frac{\theta+\frac{\pi}{2}}{w}} -f(t)dt\right].$$

6. An apparatus as in claim 5 wherein:

(a) said first phase sensitive amplitude detecting means has a transfer function $$PSD_1=\frac{2K}{P}\left[\int_{\frac{\theta}{w}}^{\frac{P}{2}+\frac{\theta}{w}} f(t)dt\right]\text{; and}$$

(b) said second phase sensitive amplitude detecting means has a transfer function $$PSD_2=\frac{2K}{P}\left[\int_{\frac{\theta+\frac{\pi}{2}}{w}}^{\frac{P}{2}+\frac{\theta+\frac{\pi}{2}}{w}} f(t)dt\right].$$

7. A method for rotating cartesian coordinate signals x, y about an angle $\theta$ where x=f(t), y=f'(t) and $\theta$ is a pre-determined angle, comprising the steps of:

(a) converting the cartesian coordinate signals x, y into a polar coordinate wave form signal $F(\sigma,\phi,t)=\sigma \sin(2\pi ft-\phi)$ where $\sigma$ and $\phi$ are polar coordinate values defined by $\sigma=\sqrt{x^2+y^2}$ and $\phi=\arctan y/x$, (b) varying the phase of the resulting polar coordinate signal $F(\sigma,\phi,t)$ by a predetermined angle $\theta$; and (c) converting the resulting polar coordinate signal $F(\sigma,\phi,\theta,t)=\sigma \sin(2\pi ft-\phi-\theta)$ back into cartesian coordinate signals x', y' using phase sensitive amplitude detecting means where $$x'=x\cos\theta-y\sin\theta$$

$$y'=y\cos\theta+x\sin\theta.$$

8. A method as in claim 7 wherein the step of converting includes:

(a) analog multiplying said cartesian coordinate signals x, y by respective signals proportional to sin $2\pi ft$ and cos $2\pi ft$ where f is the frequency of a carrier signal; and (b) summing said signals $F(\sigma,\phi,t)$ into a combined polar coordinate signal which is a function of the signals x, y.

9. A method as in claim 7 including the step of sampling said polar coordinate signal $F(\sigma,\phi,t)$ at intervals referenced to a carrier signal of frequency f and proportional to the rotation angle $\theta$ so that the resulting polar coordinate signal $F(\sigma,\phi,\theta,t)$ is converted back to cartesian coordinate signals x', y'.

10. A method as in claim 7 wherein said phase sensitive amplitude detecting means is actuated by reference signals from a timing means and including the step of delaying the reference signals with respect to a carrier signal of frequency f by an amount proportional to the rotation angle $\theta$, where $$\theta=(T/P)360°$$

where T=the time delay and P=the period of the carrier signal.

11. A method as in claim 7 including the steps of delaying the polar coordinate signal $F(\sigma,\phi,t)$ with respect to a carrier signal from a timing means of frequency f by an amount proportional to the rotational angle $\theta$ where $$\theta=(T/P)360°$$

where T=the time delay and P=the period of the carrier signal.

* * * * *